United States Patent [19]

Morton, Jr.

[11] 4,380,730

[45] Apr. 19, 1983

[54] ELECTRICAL POWER REGULATING APPARATUS AND METHOD

[76] Inventor: Henry H. Morton, Jr., 100 Covington St., Wadesboro, N.C. 28170

[21] Appl. No.: 261,259

[22] Filed: May 6, 1981

[51] Int. Cl.[3] ..... G05F 5/00

[52] U.S. Cl. ..... 323/300; 323/235; 323/237

[58] Field of Search ..... 323/217, 235, 237, 239, 323/243, 244, 299, 300, 320, 325, 326

[56] References Cited

U.S. PATENT DOCUMENTS 3,601,688 8/1971 Dogadko et al. ..... 323/300 X 3,602,804 8/1971 Randall ..... 323/300 X 4,168,476 9/1979 Petrizio ..... 323/300

4,183,082 1/1980 Ishii ..... 323/303 X

*Primary Examiner*—William M. Shoop

*Attorney, Agent, or Firm*—Bell, Seltzer, Park & Gibson

[57] ABSTRACT

An apparatus and method for regulating alternating current electrical power conducted to an electrical load wherein a gate control bidirectional semiconductor switch is controlled by a sensing circuit which includes feedback elements for responding to fluctuation in voltage supplied from a power source and in current demanded by the load for maintaining a predetermined average voltage delivered through the apparatus and in accordance with the method.

12 Claims, 1 Drawing Figure

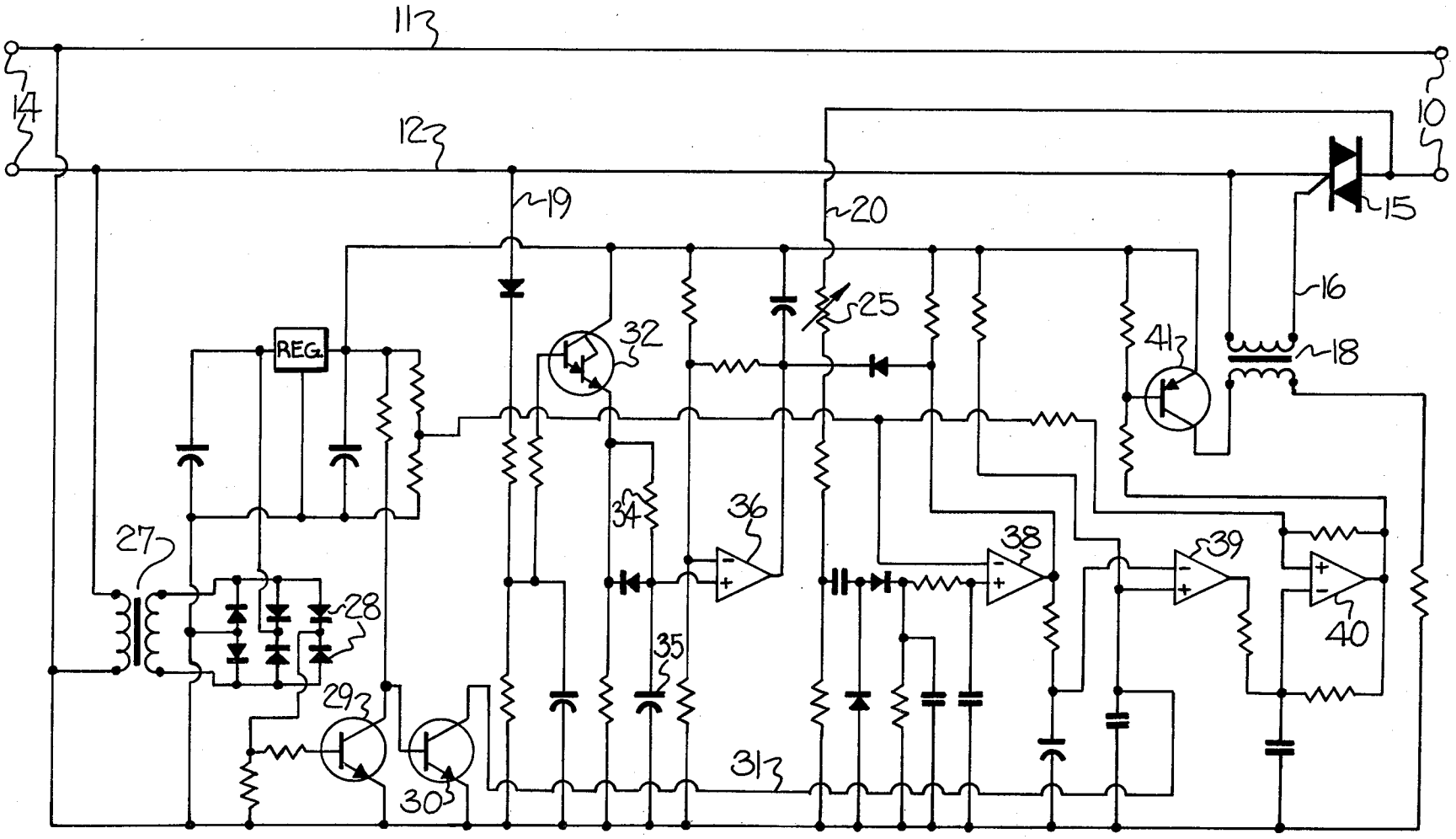
10
15
16
18
40
39
41
38
20
25
36
31
35
32
34
19
11
12
30
REG.
28
29
27
14

ELECTRICAL POWER REGULATING APPARATUS AND METHOD

FIELD AND BACKGROUND OF INVENTION

The regulation of electrical power delivered to a load such as a lamp has been proposed and accomplished heretofore. Depending upon the nature and characteristics of the particular load involved, such regulation has been directed to controlling levels of illumination from lamps, speeds of motors, temperatures of electrical heaters, and other such characteristic operations. As the technology associated with such control over electrical power has developed, various types of apparatus have been proposed and used to accomplish such control.

In many instances, the range of usefulness of particular controls is limited by interactions between the electrical load and the control. Further, it is recognized as being desirable to avoid loss of electrical power in the apparatus employed to control the load.

Achievement of these objectives has not always been available or possible. By way of example only, early controls reliant upon varying resistance directly satisfactorily accomplished control over certain types of electrical loads such as incandescent lamps but resulted in relatively great losses. More recently developed technology, using semiconductor switches, avoids the loss realized by some early control apparatus but often times is limited to specific environments of use and are not widely applicable to a number of different types of electrical loads.

BRIEF DESCRIPTION OF INVENTION

It is an object of the present invention to accomplish the regulation of electrical power delivered to an electrical load in a manner which is energy efficient. In realizing this object of the present invention, power supplied to a particular electrical load is matched to that required to facilitate maintaining power consumption at the minimum appropriate for proper load performance.

Yet a further object of the present invention is to accomplish the operation of an electrical load in accordance with a method by which fluctuations in voltage supplied and in current demanded by a load are accommodated by restoring electrical power delivered to the load to a predetermined level. In realizing this object of the present invention, electrical power delivered through a controller is sampled and the controller is signaled so as to insure a stable and accurate delivery of the required power to the load.

BRIEF DESCRIPTION OF DRAWING

Some of the objects of the invention having been stated, other objects will appear as the description proceeds, when taken in connection with the accompanying drawing, in which A schematic diagram of a controller apparatus in accordance with the present invention is shown.

DETAILED DESCRIPTION OF INVENTION

While the present invention will be described hereinafter with particular reference to the accompanying drawing, in which an operating embodiment of the apparatus of the present invention, is shown, it is to be understood at the outset of the description which follows that it is contemplated that apparatus and methods in accordance with the present invention may be varied from the specific form described herein while still attaining the desired result of this invention. Accordingly, the description which follows is to be understood as a broad teaching disclosure directed to persons of appropriate skill in the appropriate arts, and not as limiting upon the scope of this invention.

Referring now more particularly to the drawing, the present invention contemplates an apparatus for and a method of regulating alternating current electrical power conducted to an electrical load. In the accompanying figure, the electrical load is not shown. However, it is assumed that an appropriate load may be connected to output terminals 10 provided for the apparatus of the present invention. The load may take the form of fluorescent lights or any other such load as is deemed appropriate by the person of ordinary skill in the art. Conductor means 11, 12 are provided for operative connection with an alternating current electrical power source, through input terminals 14. As will be understood, the electrical power source may be an electrical utility or any other appropriate source of conventional power. In such an electrical power system, it is conventional for one conductor 11 to be a common lead and the other conductor 12 to be a feed. Other appropriate arrangements will occur to skilled electrical technicians.

A gate controlled bidirectional semiconductor switch 15 is electrically interposed in the conductor means, preferably by insertion into the feed conductor 12. The semiconductor switch 15 may be of a known type, such as the switch offered commercially under the name Quadrac, which is operable in conductive and nonconductive states for controlling conductance of alternating current electrical power from the source to the load. As is known to persons of ordinary skill in the art, such a semiconductor switch 15 may be gated into a conductive state, or "turned on" by the application of a signal to a gate terminal 16. Substantial development work has been done around the use of such semiconductor switches in circuits where the switch is gated into a conductive state at a predetermined phase angle in the cyclic variation of an alternating current supplied from an electrical power source. To any extent necessary or appropriate to an understanding of this invention, the reader is referred to conventional and generally available texts describing the gating characteristics of such semiconductor switches and to control of such switches by varying the alternating current phase angle at which the switch is "fired," gated into a conductive state, or "turned on."

In the specific circuit shown, a gating signal is applied to the gate terminal 16 through a transformer 18. As indicated, one winding of the transformer 18 is connected between the feed conductor 12 (running toward the supply or input terminal 14) and the gate terminal 16 of the semiconductor switch 15. By such an arrangement, the semiconductor switch 15 may be gated into conductive state by the application of a pulse signal through the transformer 18 and will be maintained in conductive state thereafter, through a portion of the cyclic variation of the alternating current electrical power.

In accordance with the present invention, a sensing circuit means is provided which is electrically coupled to the semiconductor switch 15 for gating the switch into conductive state. The sensing circuit means is also electrically coupled to the conductor means for sensing fluctuation in voltage supplied from the source and in current demanded by the load as reflected in sensed voltage due to supply line resistance. More particularly, the sensing circuit means is electrically coupled with a winding of the transformer 18 for applying gating pulse signals thereto and, by means of a supply voltage tap provided by a conductor 19 connected to the feed conductor 12 between the input terminal 14 and the semiconductor switch 15, and an output voltage tap provided by a conductor 20 connected between the semiconductor switch 15 and the output terminal 10, senses the indicated fluctuations.

Voltage and current fluctuations are responded to by a feedback means which develops a DC voltage representative of the average voltage delivered to a load through the output terminals 10 and which is used to adjust the phase angle of the gating of the semiconductor switch 15 and maintain a predetermined average voltage/time output as the load or the incoming supply voltage fluctuates. The dual responsiveness of the apparatus and method of the present invention to fluctuation in both voltage applied and current demanded is an important characterizing feature of the present invention.

In order to establish a predetermined average voltage to be supplied through the apparatus and method of the present invention, the sensing circuit means includes a setpoint means. In the specific form illustrated, the setpoint means takes the form of a variable resistance 25 interposed in the output tap conductor 20 as pointed out more fully hereinafter. The use of a manually adjusted variable resistance 25 accommodates the apparatus of the present invention to such applications as a fluorescent lamp dimmer. However, the resistance may be other than a manually variable resistance and may take such forms as a light sensitive resistor or a temperature sensitive resistor where the load to be controlled requires a predetermined average voltage dependent upon some characteristic other than manual control. Persons of ordinary skill in the arts of electrical power control will recognize the range of possibilities inherent in these suggestions and will be able to apply the circuit herein described more generally.

The sensing circuit means includes a low voltage power supply having a transformer 27 connected to the input terminals 14 for supplying a suitable low voltage to other circuit components. By means of a bridge and regulation circuit, suitable direct current power is applied to other circuit components functioning as a feedback means for responding to voltage and current fluctuation by maintaining a predetermined average voltage through the gate controlled bidirectional semiconductor switch 15. The power supply components need not here be described in detail, as the selection and arrangement of such components is well known to the person of ordinary skill in the applicable arts. By means of a pair of diodes 28 and associated transistors 29, 30, a zero crossing detector means is provided for indicating fluctuations of voltage supplied through cyclical zero points of the alternating current wave. More particularly, upon each crossing of the cyclic wave through a zero point, in either positive going or negative going directions, the output of one transistor 30 drops toward ground. The zero crossing signal thus derived is employed in other points in the sensing circuit means for phase timing correction, being supplied through a conductor 31 connected to an amplifier as pointed out more fully hereinafter.

By means of a Darlington amplifier 32 and an associated resistor 34 and capacitor 35, an output derived from an amplifier 36 is responsive over an interval of time to the presence of voltage supplied. Because the amplifier 36 sets a threshold for other circuit elements, increases in voltage supplied through the input terminals 14, sensed through the tap conductor 19, are integrated over an interval of time so as to decrease the average voltage conducted through the semiconductor switch 15 from an average voltage higher than a predetermined setpoint average voltage to the predetermined setpoint average voltage. In one specific application of the apparatus and method of the present invention to the control of fluorescent lighting, the interval of time provided may be relatively long, on the order of four minutes, so as to allow fluorescent lamps to heat to operating temperature before control at the pedetermined setpoint average voltage is established. Thus, there is an initial interval of "full on" power delivery.

Upon occurrence of a fluctuation in current demanded by the load, average voltage between the semiconductor switch 15 and the output terminal 10 will fluctuate and, through tap conductor 20, be directed to an amplifier 38. The differentiation circuit provides an input to an integration circuit associated with a timing control amplifier 39 which receives signals from the outputs of the amplifiers 36, 38, and zero crossing signals from the transistor 30 described hereinabove. The output of the last mentioned amplifier 39 functions to control generation of a short duration negative going pulse by a control amplifier 40 connected with a control transistor 41 which is in turn connected with the winding of the transformer 18 described hereinabove. By means of the short duration negative going pulse emitted from the amplifier 40, connected in an astable oscillator configuration, a gating signal is passed through the transformer 18 to gate or turn on the semiconductor switch 15. The gating signal is applied at an alternating current phase angle effective for maintaining a predetermined average voltage at the output terminals 10, irrespective of variations in current demanded by the load.

In the drawings and specification, there has been set forth a preferred embodiment of the invention, and although specific terms are employed, they are used in a generic and descriptive sense only and not for purposes of limitation.

That which is claimed is:

1. Apparatus for regulating alternating current electrical power conducted to an electrical load and comprising:

conductor means for operative connection with an alternating current electrical power source and an electrical load and for conducting power from the source to the load, a gate controlled bidirectional semiconductor switch electrically interposed in said conductor means and operable in conductive and nonconductive states for controlling conductance of alternating current electrical power from the source to the load, and sensing circuit means electrically coupled to said semiconductor switch for gating said switch into conductive state and electrically coupled to said conductor means for sensing fluctuation in voltage supplied from the source and fluctuation in voltage delivered to the load caused by load current changes and line resistance, said sensing circuit means comprising setpoint means for establishing a predetermined average voltage for conductance through said semiconductor switch and feedback means for responding to voltage and current fluctuation by maintaining said predetermined average voltage.

2. Apparatus according to claim 1 wherein said feedback means comprises means responsive to increases in voltage supplied for decreasing the average voltage conducted through said semiconductor switch over an interval of time from an average voltage higher than said predetermined average voltage to said predetermined average voltage.

3. Apparatus according to claim 1 wherein said feedback means comprises means responsive to decreases in the average voltage conducted through said semiconductor switch and indicative of increase in current demanded by the load for increasing the average voltage conducted through said semiconductor switch from an average voltage lower than said predetermined average voltage to said predetermined average voltage.

4. Apparatus according to claim 1 wherein said sensing circuit means comprises zero-crossing detector means for indicating fluctuations of voltage supplied through cyclic zero points, said detector means being electrically coupled to said feedback means for interrupting gating of said semiconductor switch.

5. Apparatus according to one of claims 1, 2, 3 or 4 wherein said feedback means responds to fluctuation by varying the alternating current phase angle after zero-crossing at which said semiconductor switch is gated into conductive state.

6. Apparatus for regulating alternating current electrical power conducted to an electrical load and comprising:

conductor means for operative connection with an alternating current electrical power source and an electrical load and for conducting power from the source to the load;

a gate controlled bidirectional semiconductor switch electrically interposed in said conductor means and operable in conductive and nonconductive states for controlling conductance of alternating current electrical power from the source to the load; and sensing circuit means electrically coupled to said semiconductor switch for gating said switch into conductive state and electrically coupled to said conductor means for sensing fluctuation in voltage supplied from the source and fluctuation in voltage delivered to the load caused by load current changes and line resistance, said sensing circuit means comprising setpoint means for establishing a predetermined average voltage for conductance through said semiconductor switch, means responsive to variations in voltage supplied for decreasing the average voltage conducted through said semiconductor switch over an interval of time from an average voltage higher than said predetermined average voltage to said predetermined average voltage, and means responsive to variations in the average voltage conducted through said semiconductor switch and indicative of variations in current demanded by the load for increasing the average voltage conducted through said semiconductor switch from an average voltage lower than said predetermined average voltage to said predetermined average voltage.

7. Apparatus according to claim 6 wherein said sensing circuit means comprises zero-crossing detector means for indicating fluctuations of voltage supplied through cyclic zero points, said detector means being electrically coupled for interrupting gating of said semiconductor switch, and wherein said circuit means responds to voltage and current fluctuation by varying the alternating current phase angle after zero-crossing at which said semiconductor switch is gated into conductive state.

8. Apparatus according to claim 6 wherein said setpoint means comprises a variable resistor electrically connected with said differentiation circuit means.

9. A method for regulating alternating current electrical power conducted to an electrical load and comprising steps of establishing a predetermined average voltage for conductance through a gate controlled bidirectional semiconductor switch from an alternating current electrical power source and to an electrical load, and selectively gating the switch into conductive state in response to fluctuation in voltage supplied from the source and in current demanded by the load so as to maintain the predetermined average voltage conducted through the semiconductor switch.

10. A method according to claim 9 wherein the step of selectively gating the semiconductor switch comprises responding to increases in voltage supplied by feeding back a signal effective for decreasing the average voltage conducted through the semiconductor switch over an interval of time from an average voltage higher than the predetermined average voltage to the predetermined average voltage.

11. A method according to claim 9 wherein the step of selectively gating the semiconductor switch comprises responding to decreases in the average voltage conducted through the semiconductor switch and indicative of increase in current demanded by the load by feeding back a signal effective for increasing the average voltage conducted through the semiconductor switch from an average voltage lower than the predetermined average voltage to the predetermined average voltage.

12. A method according to claim 9 further comprising indicating fluctuations of voltage supplied through cyclic zero points and interrupting gating of the semiconductor switch upon fluctuation through a cyclic zero point.

* * * * *